United States Patent [19]

Minamizono

[11] 4,072,823

[45] Feb. 7, 1978

[54] MOVING MAGNET PICKUP

[75] Inventor: Tsugikuma Minamizono, Numazu, Japan

[73] Assignee: Kabushiki Kaisha Mitachi Onkyo Seisakusho, Japan

[21] Appl. No.: 691,077

[22] Filed: May 28, 1976

[30] Foreign Application Priority Data

| | | |
|---|---|---|
| June 6, 1975 | Japan | 50-68415 |
| Aug. 22, 1975 | Japan | 50-101755 |
| Apr. 12, 1976 | Japan | 51-41076 |
| Apr. 19, 1976 | Japan | 51-44224 |

[51] Int. Cl.[2] ..... H04R 11/12

[52] U.S. Cl. ..... 179/100.41 M; 179/100.41 Z; 179/100.41 K

[58] Field of Search ..... 179/100.41 M, 100.41 Z, 179/100.41 K; 360/124; 274/37

[56] References Cited

U.S. PATENT DOCUMENTS

| | | | |
|---|---|---|---|
| 3,014,993 | 12/1961 | Narma | 179/100.41 M |
| 3,665,123 | 5/1972 | Ikeda | 179/100.41 M |
| 3,763,335 | 10/1973 | Morita | 179/100.41 M |
| 3,987,255 | 10/1976 | Kawakami | 179/100.41 M |

FOREIGN PATENT DOCUMENTS

| | | | |
|---|---|---|---|
| 21,243 | 10/1965 | Japan | 179/100.41 Z |

*Primary Examiner*—Bernard Konick
*Assistant Examiner*—Alan Faber

[57] ABSTRACT

An electrodynamic type cartridge comprises two coiled bodies composed of two frames or cores made of magnetic permeability material wound respectively by coils along the longitudinal direction thereof, the axes of which are positioned in parallel therewith, and a magnet or an armature made of magnetic permeability material integrally formed with a stylus cantilever, which is positioned in parallel with the axes of the coil frames and on the plane dividing equally the distance between the axes and is so designed that the magnet or the armature is adapted movably for the flux penetrating the coil to cut the coil at a right angle. The respective cores form the major portion of the magnetic path.

5 Claims, 16 Drawing Figures

MOVING MAGNET PICKUP

BACKGROUND OF THE INVENTION

1. Field of the Invention

This invention relates a system for converting mechanical vibration signals to electrical signals in an electromagnetic type cartridge, and more particularly to a converting system wherein magnetic flux directly cuts coils in a manner such that in the vibration system there is used a simple construction such as the moving magnet type or induced magnet type and in the converting system there is not used such medium as pole pieces.

2. Description of the Prior Art

Transducer systesm may be classified into two kinds in which one is concerned with moving magnet type (hereinafter called as "MM Type") or induced magnet type (hereinafter called as "IM Type") and the other type is concerned with moving coil type (hereinafter called as "MCType").

The former type, namely, MM Type or IM Type is such a system that magnetic flux from the magnet or magnetic permeability material is vibrated, corresponding to which pole pieces are arranged, and a magnetic circuit is formed with the pole pieces so that a coil may sense the change in increase or decrease of the magnetic flux to induce voltage in the coil. In other words, a magnet or an armature is forced to thereby be vibrated, by which the change in magnetic flux is firstly transmitted to the pole pieces, through which voltage is induced in the coil.

The MC type cartridge is a system such that a coil itself is forced to be moved in a constant magnetic flux density to cut directly the magnetic flux without any medium.

Comparing these two systems in advantagous points and disadvantages respectively, in the former, the mechanical vibration system comprises only a magnet or an armature, a contilever and a stylus tip to thereby make the construction simple and to enable the effective mass of a stylus tip to be reduced Further, this type has the advantage that a high output voltage may be taken in that the number of windings can be increased. This type cartridge is, accordingly, mainly used in an electromagnetic type cartridge and widely used both in high class and popular class. However, in converting from mechanical signals to electrical signals, such an intermedium as pole pieces is inevitably used as aforementioned, through which an output voltage is induced in a coil. The coil voltage is, however, influenced by the magnetostriction or frequency characteristics of the magnetic material of the pole pieces to thereby make it impossible to convert with highfidelity from mechanical vibration signals to electrical signals and hence this type cartridge has the disadvantage that re-produced sound of high-fidelity is unable to be obtained.

On the other hand, in the latter type cartridge in which a coil formed integrally with a stylus cantilever is placed in magnetic filed having a constant magnetic flux density and is so arranged as to cut at a right angle the magnetic flux of direct current magnetic field, there is the advantage that output voltage may be induced in the coil with high fidelity in accordance with the movement of the coil due to the absence of an intermedium such as pole pieces which would cause a distortion or undesired influence between the coil and the direct current magnetic field. In other words, due to the conversion directly from mechanical vibration signals to electrical signals, this type has the merit that hi-fi reproduced sound is obtainable. However, the disadvantage exists that the mechanical impedance of a stylus tip necessarily increases owing to the complication of the mechanical vibration system because the coil itself is vibrated. In addition, the number of windings can not virtually increase so that high output voltage is not obtainable, which results in requiring a booster transformer for practical operation. This type has a further disadvantage that the stylus may not be replaced due to the coil being integrally formed in the mechanical vibration system and that the number of manufacturing process inevitably increases to increase accordingly the cost of the product. Therefore, this type is now used only in high-class of product.

SUMMARY OF THE INVENTION

This invention accordingly proposes a noval system which incorporates the advantageous points from the conventional two systems and may also eliminate the disadvantages of these conventional systems. That is, the vibrating system is made simple as in the MM Type or IM Type, while in the converting system of mechanical signals to electrical signals, no medium such as pole piece is used.

Therefore, the object of the invention is to provide an electrodynamic type cartridge with high conversion efficiency, such that magnetic flux directly cuts coils without any medium in the conversion from mechanical signals to electrical signals.

Another object of the invention is to provide an electrodynamic type cartridge with good S/N ratio wherein the coil is divided into two parts and a magnet is disposed at the border line of the divided coils and only the component where the magnetic flux cuts the coils is allowed to be detected as output voltage.

Another object of the invention is to provide an electrodynamic type cartridge embodying a simple stylus cantilever assembly which comprises only a stylus tip, a cantilever, and a magnet or an armature of magnetic permeability material to make the effective mass of the stylus tip reduced and to make the assembly capable of replacement.

Another object of the invention is to provide an electrodynamic type cartridge wherein the number of windings of the coil in the conversion system can be increased to obtain high output voltage without transformers.

Still another object of the invention is to provide a simple electrodynamic cartridge wherein the main parts of construction are only two bodies wound by coils which are located in parallel with each other to make the arrangement simple and to make it possible to greatly reduce the number of processes of construction.

Another object of the invention is to provide an electrodynamic type cartridge which is capable of stereophonic operation.

Other objects and features of the invention may be readily appreciated hereinafter with reference to the drawings.

DETAILED DESCRIPTION OF THE EMBODIMENTS

Figure 1:
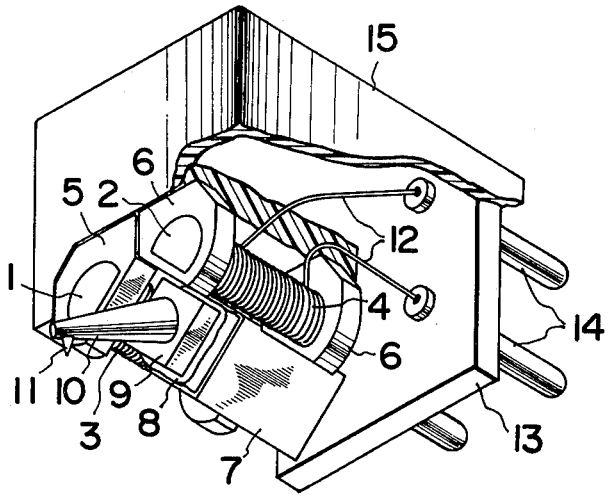
FIG. 1 is a perspective view of one embodiment of this invention showing the arrangement, partially broken away.

Referring now to FIG. 1, numerals 1 and 2 show respectively coil frames for right channel and for left channel, around which coils 3 and 4 respectively are wound at a right angle to the longitudinal directions of the coil frames. 5 and 6 are fastening plates to support the coil frames 1 and 2 respectively. The coil frames 1 and 2 are parallel to each other, as shown in the drawing, and these frames are so arranged as face each other at some angle within whose angle there is located a stylus cantilever assembly which comprises magnet 9, cantilever 10 and stylus tip 11. This assembly is damped with damper rubber 8, and is supported by the stylus holder 7. It is so arranged and movably constructed as to be vibrated with sound grooves and the magnetic flux from the magnet 9 of this assembly is adapted to cut the two coils at a right angle so as to make it possible to take out the signals corresponding to the movement of the stylus tip. Numeral 13 is a terminal plate provided with terminal pins 14 which project from the terminal plate 13 for connection with an amplifier which amplifiers reproduced signals. The construction for the right channel is likewise so arranged. Numeral 15 shows a fastening block to support the coil fastening plates 5 and 6, and terminal plate 13.

Figure 3:
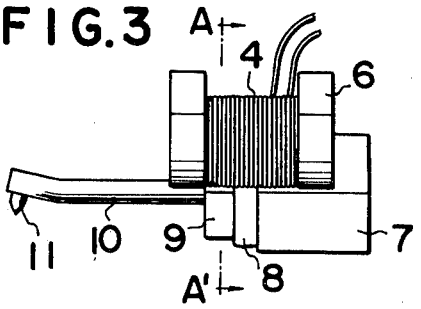
FIG. 3 illustrates the relationship of a coil and a magnet formed integrally with a stylus cantilever in the embodiment of FIG. 1.

According to the FIGS. 3, 4 and 5, the principle of operation will be concretely explained below. To facilitate the understanding of the principle, unnecessary parts have been taken away. In FIG. 5, let us consider L-channel (left channel) alone, the right channel also being similarly operated. The magnetic flux from the N pole of the magnet 9 forms the magnetic circuit through the coil frame 2 made of magnetic permeability material as a magnetic path to the S pole of the magnet 9. Therefore, the portion between the magnet 9 and the coil frame 2 keeps a constant magnetic flux density. Where the stylus tip 11 which picks up the signals of sound grooves is moved about the vibration fulcrum 0 as indicated by the mark "X", then the movement of the magnet 9 most adjacent to the surface of the coil 4 becomes the rotative motion around the vibration fulcrum 0 as shown by the mark "Y". Thus, the flux from the magnet comes into cutting perpendicularly the coils which results in obtaining best efficiency. That is, the following electromotive force is induced in the coil, $$e = BLv[\mathrm{v}]$$

in which

*B:* magnetic flux density of the portion of the coils

*l:* active length of the coil

*v:* movement velocity of the magnetic flux

The relationship of the positions between the magnet 9 and the coil 4 is placed, as shown in FIG. 5, apart from and closely at the one end of the coil 4 whereby the magnetic flux will always cut the coil in the same direction. This is because of the following. The directions of magnetic flux of the magnet 9 are opposite between the N pole and the S pole, while the directions of the movement of the magnetic flux are the same. Therefore, if the magnet is placed in the intermediate portion of the coil, anti-phase voltages would be induced to appear as the remaining voltage from cancelled voltages therebetween. In order to avoid this phenomenon, magnet 9 is allowed to be positioned nearby on the one side of the coil 4 so as to make the induced voltage corresponding only to one pole, N pole or S pole but not to the other pole. Further, in order to make the magnetic flux density of the coil higher, the coil frame 2 extends outwardly longer than the portion would by the coil to make the magnetic reluctance low.

Figure 4:
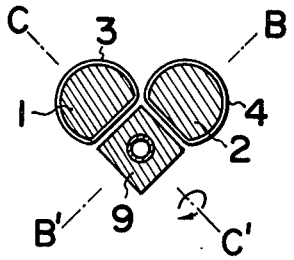
FIG. 4 is a diagram for explanation of crosstalk, and is taken along line A—A' of FIG. 5 is a diagram for explanation of the principle of power generation showing the magnetic circuit of the embodiment of FIG. 1.
Figure 5:
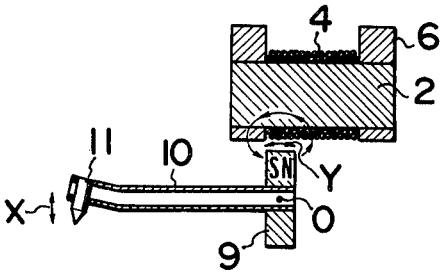

For the right channel, the arrangement is similarly designed, and the FIG. 4 is the sectional view showing the relationship of the allocation for right- and left channels.

Figure 6:
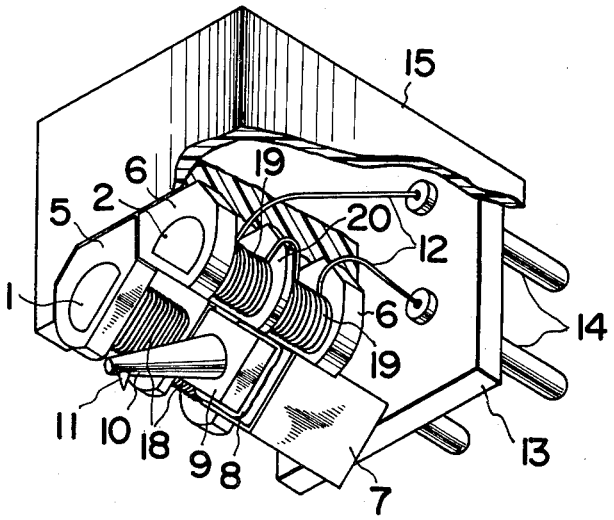
FIG. 6 is a perspective view of another embodiment in which the coil is divided equally into two parts, and the drawing is partially broken away.
Figure 2A:
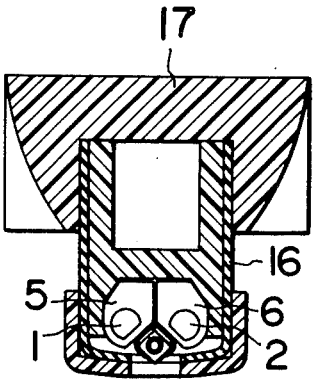
FIGS. 2A, 2B, and 2C are respective sectional views of the construction of FIG. 1.
Figure 2B:
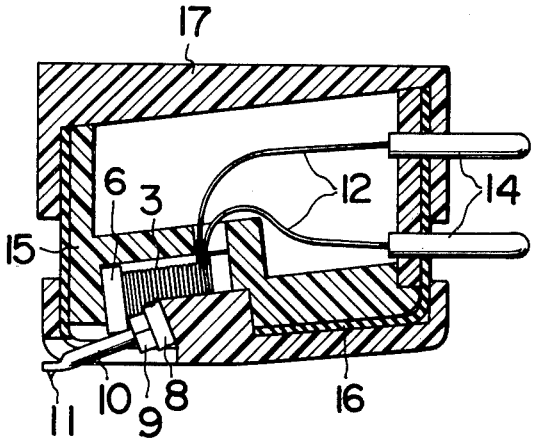
Figure 2C:
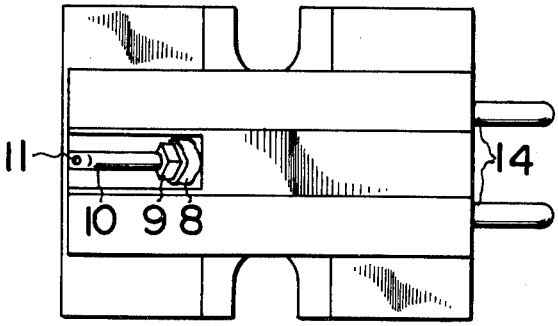
Figure 7:
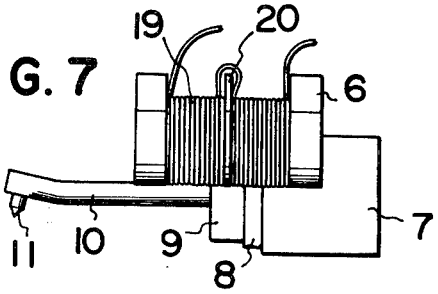
FIG. 7 illustrates the relationship of two divided coils and a magnet in the embodiment of FIG. 6.
Figure 8:
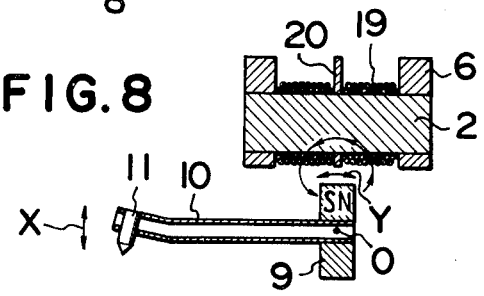
FIG. 8 is a diagram for explanation of the principle of power generation showing the magnetic circuit of FIG. 7.
Figure 9:
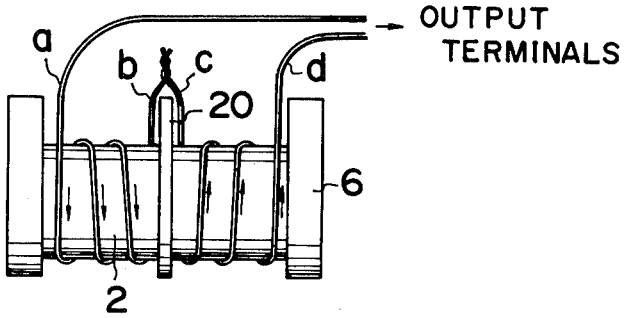
FIGS. 9 and 10 indicate directions of windings and connections of the respective divided coils.
Figure 10:
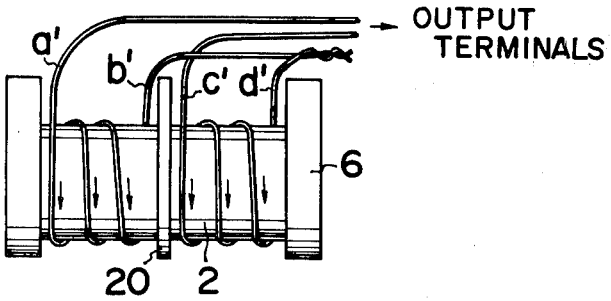

In FIG. 6, there is shown another embodiment wherein the respective coils are divided into two parts, the winding numbers of which are substantially the same. Numeral 20 is a separation plate. Numerals 18 and 19 indicate respectively separated coils for right- and left- channels. Other parts are corresponding to those in FIG. 1. Where the magnet 9 is, as shown in FIGS. 7 and 8, placed in the center portion of the coil, it is impossible to take out the output voltage in the coil as heretofore described. In order to avoid this phenomenon, the coil is divided and the respective separated coils are so wound and connected so that positive-phase-sequence voltages are allowed to be induced both in the portion of the coil cut by the magnetic flux of N-pole and in the portion of coil cut by the flux of S-pole of the magnet 9. That is to say, as shown in FIG. 9, on the opposite sides of the border plane which equally divides the N polarity surface and S polarity surface of the magnet 9, the respective divided coils are would in opposite directions about the coil frame, in which the ending (*b*) of one separated coil and the beginning (*c*) of the other separated coil are connected together and output voltage is taken out from the remaining ends of the respective separated coils, that is, from the beginning (*a*) of the one separated coil and the ending (*d*) of the other separated coil. Or as shown in FIG. 10, the directions of the two separated coils are the same wherein the endings (*b'*, *d'*) of the windings of the respective separated coils are connected together and the output voltage is taken out from the remaining beginnings (*a'*, *c'*) of the windings, or conversely the beginnings (*a'*, *c'*) could be connected together while the output voltage is taken out from the endings (*b'*, *d'*). In these conditions, the voltage induced by the magnetic flux of the N-pole portion of the magnet 9 cutting the coil, and the voltage induced by the magnetic flux of the S-pole portion are both positive-phase, thereby obtaining the sum of the voltages of the respective coils as an output voltage.

Figure 11:
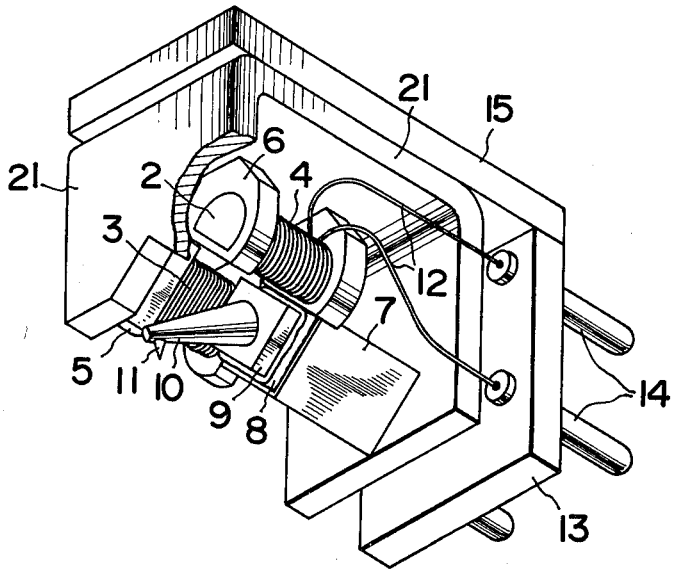
FIG. 11 is a perspective view of another embodiment wherein a yoke is used in the magnetic circuit.
Figure 12:
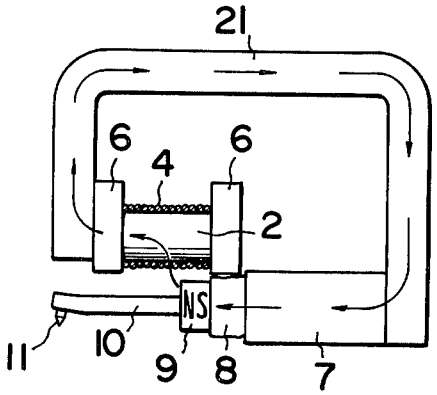
FIG. 12 illustrates the magnetic circuit of FIG. 11.
Figure 13:
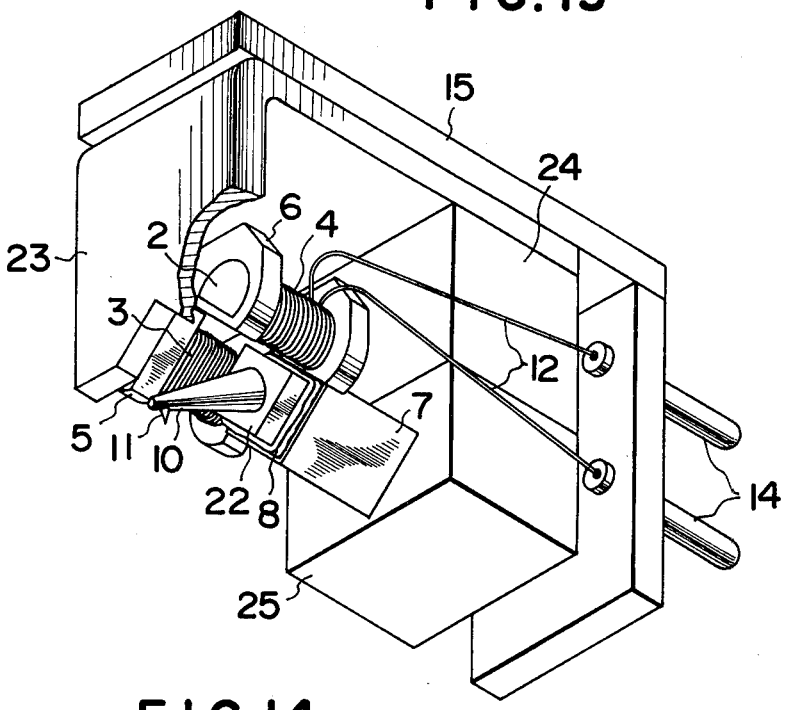
FIG. 13 is a perspective view of another embodiment wherein a yoke is used in the magnetic circuit and an armature made of magnetic permeability material is used in the stylus vibration system.

FIGS. 11 and 13 show other embodiments wherein the magnetic circuit is formed differently from the above embodiments but the other parts are similarly arranged to those of FIG. 1. FIG. 12 illustrates the magnetic circuit of FIG. 1 wherein the magnetic flux derived from N pole of the magnet 9 formed integrally with the stylus cantilever passes via coil frame 2, the yoke 21 formed of magnetic permeability material, through the needle holder 7 and returns to the S-pole of the magnet to form a closed magnetic circuit. This embodiment is different from the embodiments of FIG. 1 only in the point of the magnetic circuit but these are both the same in the principle of power generation so that output voltage may be induced, as in the above embodiment, in the opposite ends of the coil 4.

Figure 14:
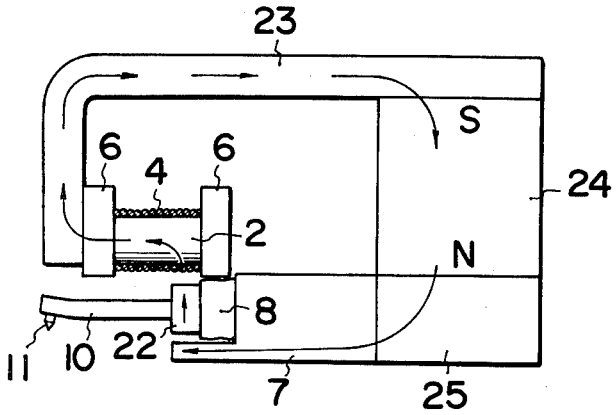
FIG. 14 illustrates the magnetic circuit of FIG. 13.

In FIG. 13, magnet 24 is not mounted in the stylus vibration system but interposed within the other magnet circuit while the vibration system is instead provided with an armature made of magnetic permeability material which is integrally formed with the cantilever and whose magnetic saturation value is high, such as iron or permendur. The principle of power generation of this embodiment will be given with reference to FIG. 14. Magnetic flux derived from N-pole of the magnet 24 flows as indicated through the yoke 25, the needle holder 7 made of magnetic permeability material, via the armature 22 integrally formed with the stylus cantilever, through coil frame 2 and yoke 23, to return to the S-pole of the magnet 24 to form a closed magnetic circuit. It goes without saying that in the armature 22, the magnetic flux from the magnet 24 is introduced as the magnetic paths through the yoke 25 and via the needle holder 7. Where signals are transmitted from the recorded sound grooves to the stylus tip, the integrally formed armature 22 will necessarily vibrate with the recorded sound grooves. The vibration modes are the same as the above mentioned. Also, the principle of power generation is the identical with those of the foregoing embodiments because those constructions are different only in the point that an armature is displaced from the magnet by magnetic permeability material, the magnetic saturation value of which is high, such as iron or permendur.

Accordingly, the magnetic flux as mentioned above, may efficiently cut the coil 4 at a right angle to enable the output voltage in the opposite ends of the coil 4 to be induced.

The explanation as mentioned heretofore was concerned with the principle of power generation with respect to one coiled body i.e., one channel. Now, the principle for stereophonic operation will be given with reference to FIG. 4 because the other embodiments are also same in the principle of power generation. In case of detecting the right hand signals, if the magnet 9 is moved rotatively about the axis of C—C', the portion of the magnet 9 facing the coil 4 for the left channel comes into the movement perpendicular to the paper surface of the drawing and accordingly the magnetic flux thereof is likewise moved. The coil 4 for the left channel signals are wound in a manner that the coil may be cut at a right angle by the flux with respect to the above movement of the magnet so that maximum efficient output voltage may be induced in the coil 4 for detection of the left channel. On the other hand, considering the surface of the magnet 9 which faces the other coil 3 for detection of the right channel, the direction of movement on the opposite sides with respect to the axis of C—C' are opposite because the magnet is moved rotatively about the axis of C—C'. Consequently, induced voltages on the right and left sides of the axis of C—C' are also opposite in phase, which results in mutually cancelling whereby no output voltage may be induced in the ends of coils 3. Similarly, in order to detect output voltage in the coil 3 for right channel signals, it is apparent to allow the magnet to move rotatively about the axis of B—B' in which case the operation is the same as in the left channel to thereby make a stereophonic operation possible.

As explained hereinabove, there is nothing to limit the winding number of the coil so that coil may be wound as much as MM Type with further advantages that higher output voltage may be obtained rather than that in MM Type due to better conversion efficiency. Replacement of the stylus is likewise possible and the principle of operation is the same as the MC Type in the point that magnetic flux directly cuts the coils. Accordingly, this invention makes it possible to incorporate advantages of the MM Type and the MC Type and to preclude the disadvantages in these Type cartridges.

Finally, advantages in this invention are concretely given below.

1. Because of using such a mechanical vibration system similarly as the MM Type or IM Type, the vibration system is simple and it is possible to make the effective mass of a stylus tip light so that the mechanical vibration system may re-produce at fidelity with recorded sound grooves.

2. In conversion from mechanical signals to electrical signals, magnetic flux directly cuts the coils so that mechanical signals may be converted to electrical signals with fidelity, without conversion loss.

3. Since the magnetic circuit is not a closed circuit from the view of the side of the coil, the inductance component is low and the output impedance of the coil is almost the d.c. resistance component whereby the frequency characteristics is flat up to high frequency.

4. In the magnetic circuit, the motions of the magnet 9 and armature 22 are not the change in distance to the coil frames but the substantially parallel movement, (Whereas in MM Type, the magnetic flux within pole pieces increase or decreases depending on the change in distance of the magnet to the pole pieces.), so that there is almost no characteristic of frequency because most parts of the flux in the magnetic circuit are direct current magnetic flux and the component of alternating current flux is extremely small.

5. In the embodiment where the coil is divided equally into two parts and at the border line thereof the magnet 9 is placed, even if the change in distance between coil frame and the magnet slightly occurs, the voltages induced by the distance change mutually cancels each other because the direction of the windings and the connections therebetween are so designed as to become anti-phase therebetween, whereby they mutually cancel and no output voltage appears in the coil. That is to say, only with regard to the component where the flux entirely cuts the coil, output voltage can be taken out in the ends of the coil. In addition, even if the change in magnetic flux having hum component by outside hum exists within the coil, similarly the voltages induced mutually cancel so that no output voltage with regard to the hum component appears in the ends of the coils. In other words, only with respect to the component where the flux entirely cuts the coil, output voltage may be detected in the ends of the coils, and further no outside hum appears in the ends of the coils to thereby improve S/N ratio.

6. In the allocation and arrangement of cartridge parts, the main parts are only two coiled bodies which are placed in parallel with each other to make simple the construction as a whole and to enable the number of it the processes of construction to be greatly reduced.

What is claimed is:

1. An electrodynamic type cartridge comprising two longitudinally extending coiled bodies each comprised of a pillar-shaped frame or core made of magnetic permeable material and each would by coils along its longitudinal direction, the center axes of said two coiled bodies being positioned in parallel with each other;

a magnet formed integrally with a stylus cantilever, the center axis of which is disposed in parallel with the axes of said two coiled bodies and on the plane dividing equally the distance between the axes of said two coiled bodies, said magnet positioned with respect to said two coiled bodied such that it respectively forms a complete magnetic circuit with each of said cores by utilizing only the respective cores for the major portion of its magnetic path, the coils of the two coiled bodies being wound through only a portion of its respective core, the magnet being adapted movably whereby the constant flux from the magnet directly cuts the respective coils in a direction substantially perpendicular thereto, and wherein said coils and magnet are cooperatively positioned whereby the induced output voltage from the coils have the same phase.

2. An electrodynamic type cartridge of claim 1, wherein the magnet is located at the one end portion of the coils, such that only one polarity of the magnet is directly adjacent to the cores, to thereby prevent the induction of inversed phase voltages in the coils.

3. An electrodynamic type cartridge of claim 1, wherein the coil of each respective coiled body is divided into two parts on the same core, the numbers of the windings of which are substantially equal, the separated coils of each respective coiled body being so wound respectively and connected to each other that induced voltages thereof have same phase, and the magnet is positioned within the two coiled bodies and at the border line of the separated coils, the N-S poles of which are arranged in parallel with the coiled bodies.

4. An electrodynamic type cartridge of claim 3, wherein the separated coils of each respective coiled body are wound in opposite directions to each other, the ending of the winding of the one separated coil and the beginning of the winding of the other separated coil being connected together and output voltage is taken from the remaining ends of each of the respective separated coils.

5. An electrodynamic type cartridge of claim 3, wherein the separated coils of each respective coiled body are wound in the same direction as each other, the beginning of the winding of one separated coil and the beginning of the winding of the other separated coil being connected together and output voltage is taken from the remaining ends of each of the respective separated coils.

* * * * *